US006212830B1

(12) United States Patent
MacKarvich

(10) Patent No.: US 6,212,830 B1
(45) Date of Patent: Apr. 10, 2001

(54) ADJUSTABLE DIAGONAL STRUT

(76) Inventor: Charles J. MacKarvich, 3940 Paces Manor Dr., Atlanta, GA (US) 30339

( * ) Notice: Subject to any disclaimer, the term of this patent is extended or adjusted under 35 U.S.C. 154(b) by 0 days.

(21) Appl. No.: 09/386,612

(22) Filed: Aug. 31, 1999

(51) Int. Cl.[7] ..... E04G 21/26
(52) U.S. Cl. ..... 52/127.2; 248/354.3
(58) Field of Search ..... 52/127.2, 693, 52/713; 248/354.3, 357

(56) References Cited

U.S. PATENT DOCUMENTS

| | | | | |
|---|---|---|---|---|
| 2,163,808 | * | 6/1939 | Pithoud | 52/127.2 |
| 2,696,359 | * | 12/1954 | Hill | 248/354.3 |
| 3,171,627 | * | 3/1965 | Tapley et al. | 248/354.3 |
| 3,503,173 | * | 3/1970 | Jureit | 52/693 |
| 3,504,880 | * | 4/1970 | Toms | 248/354.3 |
| 4,143,500 | * | 3/1979 | Sanford | 52/693 |
| 4,304,078 | * | 12/1981 | Meriwether, Jr. | 52/127.2 |
| 4,570,407 | * | 2/1986 | Palacio et al. | 52/693 |
| 5,105,598 | * | 4/1992 | Wilcox | 52/693 |
| 5,271,596 | * | 12/1993 | Holcomb et al. . | |
| 5,893,253 | * | 4/1999 | Lutz, III | 52/693 |
| 6,065,254 | * | 5/2000 | Lanka | 52/127.2 |

OTHER PUBLICATIONS

"Adjustable Outrigger Installation Instructions", Manufactured Housing Foundations Systems. No Date.

* cited by examiner

*Primary Examiner*—Blair M. Johnson
(74) *Attorney, Agent, or Firm*—Thomas, Kayden, Horstemeyer & Risley

(57) ABSTRACT

The adjustable length strut (25) includes an elongated strut plate (26) having a rectilinear C-shaped in cross-section support tube (32) and a mounting plate (36). An externally threaded rectilinear shaft (52) has its proximal end (56) inserted telescopically into the support tube (32). The threaded nut (62) mounted on the shaft engages the distal bearing edge (50) of the support tube, and rotation of the nut causes the shaft to distend from the tube for engagement with an I-beam (18) of the manufactured building structure. The chisel end (60) of the threaded shaft avoids rotation of the shaft with respect to the I-beam, so that rotation of the adjustable nut (62) provides accurate movement of the shaft out of the tube. The amount of the proximal end (56) of the shaft protruding into the support tube (32) can be visually determined by viewing through the elongated slot (42) of the support tube (32).

8 Claims, 2 Drawing Sheets

ADJUSTABLE DIAGONAL STRUT

FIELD OF THE INVENTION

This invention involves an adjustable strut adapted to support floor joists and other floor structures of a premanufactured building structure. More particularly, the invention is an adjustable strut for placement in a sloped attitude extending laterally and upwardly from an I-beam horizontal support and a floor joist or other floor structure that is supported directly on the I-beam, so as to stabilize the portion of the floor structure.

BACKGROUND OF THE INVENTION

In the production of inexpensive, premanufactured (hereinafter "manufactured") building structures, such as "mobile homes," it is desirable to utilize a pair of horizontally oriented, parallel I-beams as the base support for the structure, with the floor joist and other floor components being supported by the I-beams. With this arrangement, the floor joists extend laterally across the I-beams, with opposed ends of the floor joists extending beyond the I-beam in a cantilever arrangement, in that they overhang the I-beams.

One of the problems of this type of construction is that heavy loads are sometimes placed on the cantilevered portions of the floor structures, and the structures tend to slightly sag or give during normal wear and tear. For example, the floor structure at the entrance of a manufactured home which bears the repeated application of the weight of the people entering and exiting the home might need additional support to stabilize this area of the structure. In some instances, the placement of a heavy appliance or other spot loads are likely to need additional support in the floor structure.

While the joists utilized to form the manufactured home can be increased in size or number to accommodate the heavier and more frequent application of loads, it is considered wasteful to form the entire floor structure with an additional load-bearing capacity in order to accommodate the application of these loads at only a few locations about the entire structure.

Accordingly, diagonal struts have been utilized to support the cantilevered portions of a manufactured home. Typically, one end of a strut would be fastened to the cantilevered end portion of a floor joist, the strut would extend at a downwardly sloped angle to the lower flange of an I-beam, and engage the I-beam at the intersection of its lower flange and its central web. The strut would rely upon frictional engagement with the I-beam to remain in place.

More recently, an adjustable length strut has been developed which includes as its main body portion a cylindrical pipe section, with an adjustable nut and a threaded rod attached to the lower end for bearing against the I-beam and a thrust bracket connected to the upper end of the pipe for connection by means of screws or spikes to the floor joist. While this type of cylindrical pipe structure is adjustable and, therefore, an improvement over some of the prior art struts used for this purpose, the production of such a floor joist is expensive because it requires several parts, and the connection between the strut and the I-beam appears to be less than secure. Also, it is impossible to view the inside of the cylindrical pipe in order to determine the amount of the threaded rod that projects into the pipe or to determine the secure connection between the thrust bracket and the pipe, so that the installer or the maintenance person cannot be sure of proper mounting and maintenance of the product.

It is to these shortcomings that this invention is directed.

SUMMARY OF THE INVENTION

Briefly described, the present invention comprises an adjustable strut for supporting the floor joists of a manufactured building structure. The strut includes a unitary elongated strut plate having opposed first and second end portions, with the first end portion formed in a rectilinear C-shaped in cross-section support tube defining a longitudinal axis, and the second end portion formed in a substantially flat mounting plate typically oriented at an obtuse angle with respect to the longitudinal axis of the support tube, for fastening to the floor joist. A rectilinear shaft having external helical threads formed along at least a portion of its length has a first end portion for biasing against the I-beam that supports the floor joist and a second end portion that is telescopically received in the support tube of the strut assembly. A threaded adjustment nut rotatably engages the external helical threads of the rectilinear shaft and is movable along the length of the shaft in response to rotation about the shaft, and the nut is of larger breadth than the breadth of the support tube of the strut plate, for bearing against the end of the support tube. The nut includes a helical thread or other projection allowing for a rotation and an axial movement with respect to the shaft. The distal end of the shaft is formed in a non-circular engagement surface for engaging an I-beam of the manufactured building structure at the intersection of the lower flange of the I-beam and the central web of the I-beam.

With this arrangement, the strut is oriented with its engagement surface engaging the I-beam at the intersection of the lower flange and the web of the I-beam, and the mounting plate is placed in abutment with the cantilevered end of a joist of the floor of the manufactured building structure. Connectors, such as screws or spikes, are driven through the mounting plate into the joist. The adjustment nut is then rotated about the rectilinear shaft to progressively force the distal end portion of the shaft out of the support tube for bearing against the I-beam, thereby applying a lifting force to the joist of the manufactured building structure. The engagement surface which is non-circular preferably is designed as a chisel end of the rectilinear shaft and the chisel end engages the crotch of the intersection between the lower flange and the central web of the I-beam, assuring that the rectilinear shaft does not rotate in response to rotating the adjustable nut.

With this arrangement, the C-shaped support tube allows the installer to visually locate the internal end of the rectilinear shaft which is located inside the support tube, so as to determine the amount of shaft available for movement out of the tube.

Thus, it is an object of this invention to provide an improved adjustable length strut for supporting the cantilevered end of a floor joist of a building structure.

Another object of this invention is to provide an adjustable length strut that is formed of a minimum number of parts and which provides the necessary strength for supporting an object and which provides a means for observing the amount of expansion length that remains available to the installer or maintenance person.

Other objects, features and advantages of this invention will become apparent upon reading the following specification, when taken in conjunction with the accompanying drawings.

DETAILED DESCRIPTION

Figure 1:
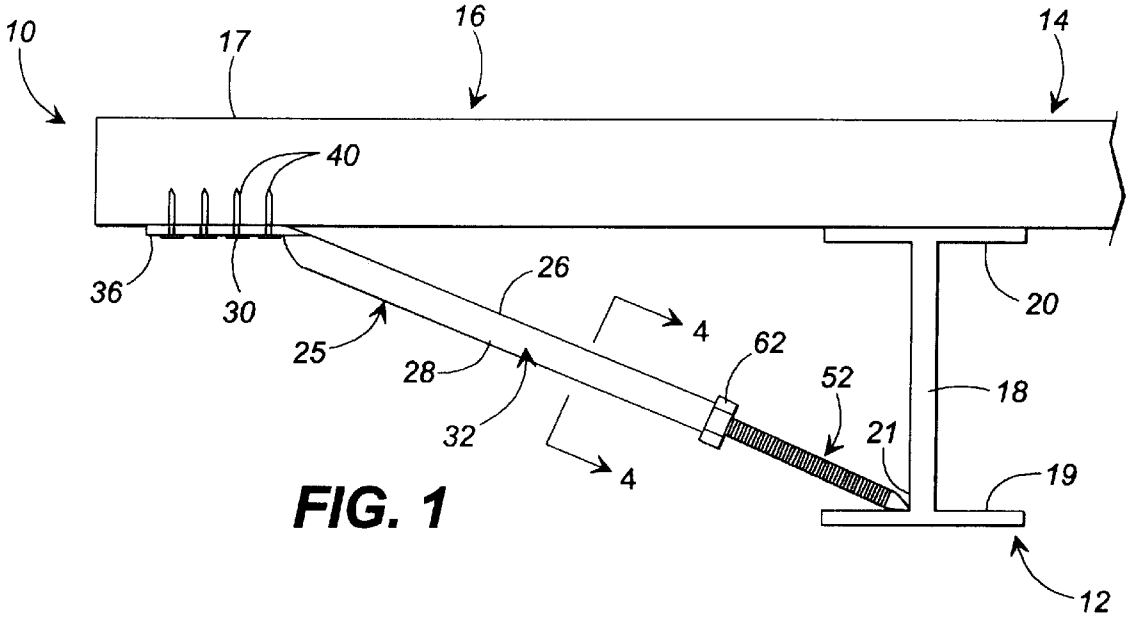
FIG. 1 is a side elevational view of the I-beam and a floor joist of a manufactured building structure, showing the adjustable length strut installed between the I-beam and the floor joist.

Referring now in more detail to the drawings in which like numerals indicate like parts throughout the several views, FIG. 1 illustrates a portion of a manufactured home 10 which illustrates one of the typical I-beams 12 and a floor joist 14 mounted on the I-beam. It will be understood that there are two I-beams arranged parallel to each other that form the support structure for the manufactured building. An end portion 16 of the floor joist 14 is arranged in a cantilever fashion with respect to the I-beam 12.

The I-beam 12 includes a central web 18, a lower flange 19 and an upper flange 20. The I-beams 12 typically are mounted on piers formed of support blocks, jacks, or other suitable structures (not shown).

Figure 2:
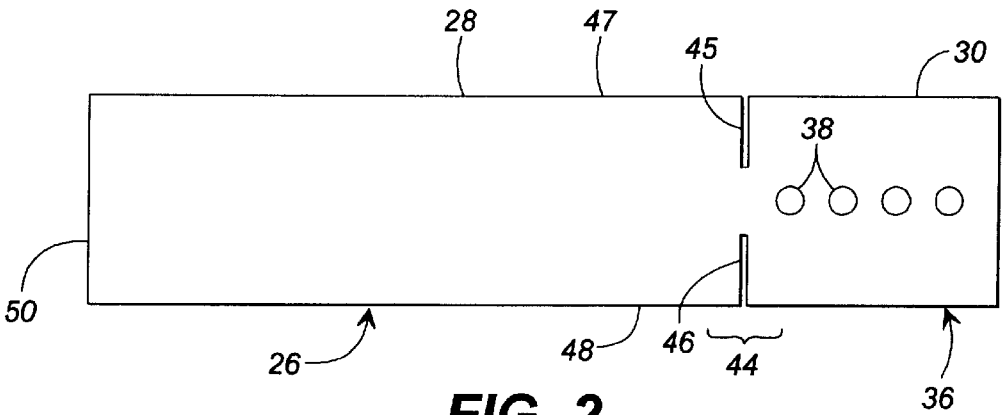
FIG. 2 is a plan view of a blank of a strut plate before it is formed into its useable shape.
Figures 3, 4:
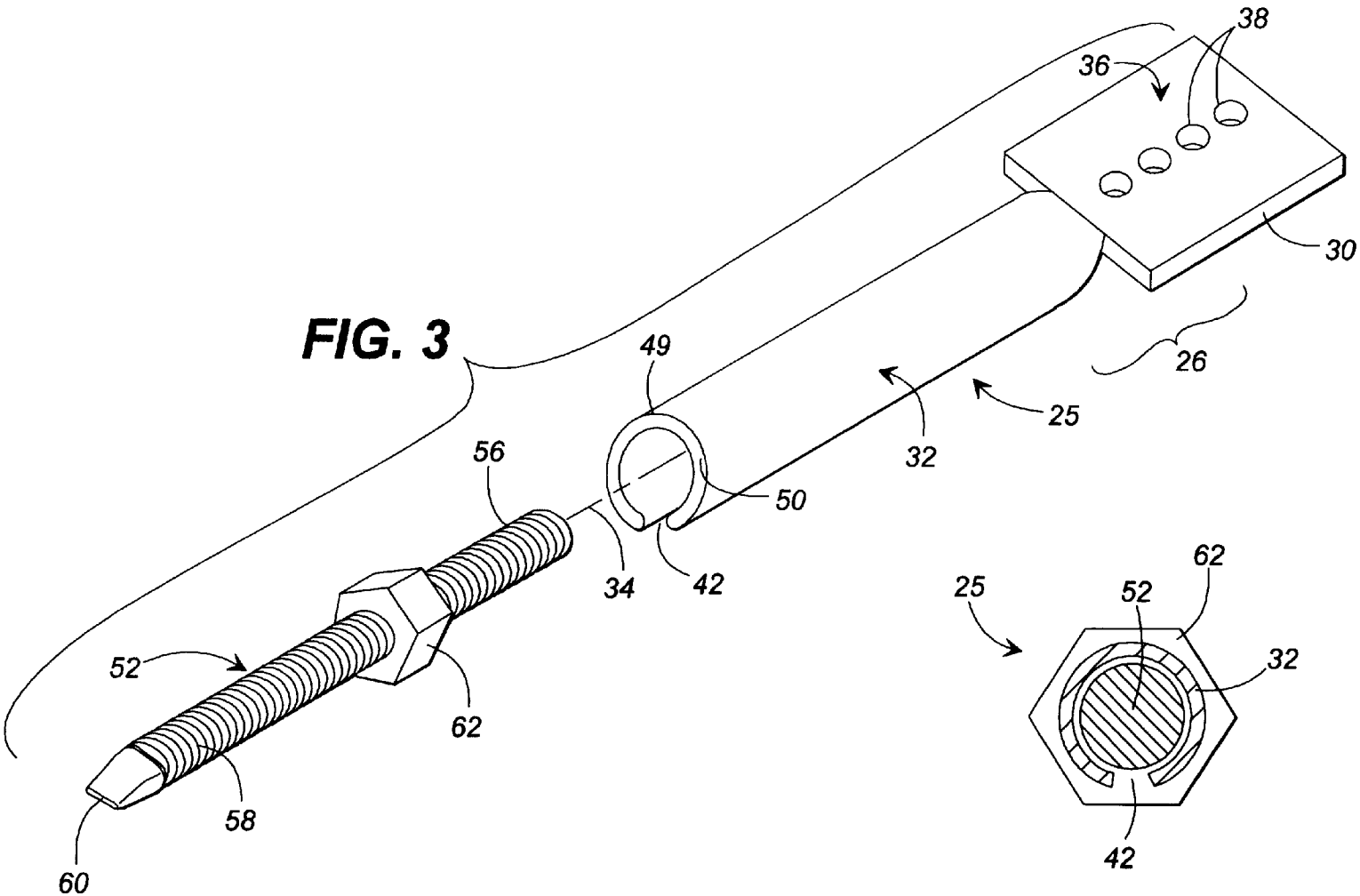
FIG. 3 is an expanded perspective illustration of the adjustable length strut.
FIG. 4 is an end cross-sectional view of the strut, taken along lines 4—4 of FIG. 1.

When sufficient weight is applied to the distal end 17 of the cantilevered end portion 16 of a floor joist 14, there is a likelihood of downward flexing of the cantilevered end portion, which is undesirable. In order to provide additional support to the cantilevered end portion 16 of the floor joist 14, an adjustable strut 25 is extended between the I-beam 18 and a distal end 17 of the floor joist 14. As illustrated in FIGS. 1 and 2, the adjustable length strut 25 includes a unitary elongated formed strut plate 26 having opposed first and second end portions 28 and 30 (FIG. 2). The strut plate 26 is initially a flat segment of sheet material as shown in FIG. 2. The first end portion 28 of the strut plate 26 is formed into a C-shaped in cross-section support tube 32 which defines the longitudinal axis 34 (FIG. 3), and the second end portion 30 is formed in a substantially flat mounting plate 36, with the mounting plate 36 defining a series of screw openings 38, for fastening the mounting plate 36 to the joist 14. Typically, screws or spikes 40 (FIG. 1) are used to connect the mounting plate 36 to the joist 14. The support tube 32 defines a rectilinear slot 42 extending along its entire length.

As shown in FIG. 2, there is a segment 44 of reduced strength between the mounting plate 36 and the support tube 32 formed in the strut plate 26. In this embodiment, the segment of reduced strength 44 is formed by notches 45 and 46 which extend inwardly from the side edges 47 and 48 of the strut plate 26. This permits the mounting plate 36 to be bent at the segment of reduced thickness 44 from an attitude approximately parallel to the longitudinal axis 34 to a sloped attitude as illustrated in FIG. 1. This reorientation of the mounting plate 36 is usually accomplished either at the factory or in the field by the installer during the installation procedures.

The distal end 50 of the support tube 32 is formed at a right angle with respect to the longitudinal axis 34 and functions as a bearing surface for the adjustment nut.

A rectilinear shaft 52 has external helical threads formed thereabout and along its length, and includes a first or proximal end portion 56 and a second or distal end portion 58. The distal end portion 58 terminates in a non-cylindrical engagement surface, such as chisel blade 60. An internally threaded adjustment nut 62 is threaded onto the shaft 52.

The proximal end 56 of the shaft 52 is inserted telescopically into the open end 49 of the support tube 32 until the adjustment nut 62 bears against the end 50 of the support tube 32 so that the end 50 functions as a bearing surface for the adjustment nut.

When the adjustable strut 25 is to be installed at the manufactured building structure, the chisel blade 60 of the rectilinear threaded shaft 52 is placed at the crotch 21 or intersection between the lower flange 19 and the central web 18 of the I-beam 12, and the mounting plate 36 is placed in abutment with the lower edge of the cantilevered end portion 16 of the floor joist 14. If necessary, the mounting plate 36 will be oriented at an obtuse angle with respect to the longitudinal axis of the support tube 32, so that the mounting plate 36 is in flat abutment with the bottom surface of the joist 14 when the support tube is oriented at a sloped attitude as shown in FIG. 1. The installer then inserts screws, spikes or other fasteners 40 through the openings 38 in the mounting plate 36. The installer then rotates the nut 62 so as to distend the rectilinear shaft 52, causing the non-circular blade 60 to bear against the crotch 21 of the I-beam 12. This applies compression from the I-beam 12 sloped upwardly through the adjustable strut 25 to the distal end 17 of the floor joist 14. This arrangement adds stability to the cantilevered end portion 16 of the joist 14.

The installer is capable of determining the amount of length of the proximal end portion 56 of the shaft 52 remaining in the support tube 32 by viewing the shaft through the rectilinear slot 42 of the support tube 32.

Although a preferred embodiment of the invention has been disclosed in detail herein, it will be obvious to those skilled in the art that variations and modifications of the disclosed embodiment can be made without departing from the spirit and scope of the invention as set forth in the following claims.

What is claimed is:

1. An adjustable length strut for extending in a sloped attitude between the intersection of the bottom flange and web of an I-beam and the floor structure of a manufactured building supported by the upper flange of the I-beam, comprising:

a unitary elongated strut formed of a strut plate having opposed first and second end portions, said first end portion of said strut formed in a C-shaped in cross-section support tube defining a longitudinal axis and defining an open ended slot extending parallel to said longitudinal axis;

said second end portion of said strut formed in a substantially flat mounting plate oriented at an obtuse angle with respect to the longitudinal axis of said support tube for fastening to the floor structure of the manufactured building;

a rectilinear one-piece shaft having external a longitudinal axis and helical threads formed along at least a portion of its length and having a first end portion for bearing against the I-beam and a second end portion telescopically received in said support tube of said strut said first and second end portions extending along the longitudinal axis of said shaft;

a nut having internal thread means sized and shaped to rotatably engage the external threads of said rectilinear shaft and to move axially along said shaft in response to rotation about said shaft, said nut being of larger breadth than the breadth of said support tube of said strut plate for bearing against said support tube;

said first end portion of said rectilinear shaft terminating in a non-circular in crosssection engagement surface for engaging an I-beam at the intersection of the lower flange and the web of the I-beam, said non-circular engagement surface being of sufficient breadth to avoid rotation with respect to the intersection of the bottom flange and web of the I-beam in response to the rotation of said threaded nut on said rectilinear shaft;

whereby the strut can be oriented with the engagement surface of the shaft in engagement with the I-beam at the intersection of the lower flange and the web of the I-beam and said mounting plate in abutment with the floor structure of the manufactured building and said mounting plate is fastenable to the floor structure of the manufactured building and the nut is rotated about the rectilinear shaft to progressively force the non-circular end portion of said rectilinear shaft away from said support tube for supporting the floor structure of the manufactured building from the intersection of the lower flange with the web of the I-beam.

2. The strut of claim 1, and wherein said engagement surface is a chisel blade end.

3. The strut of claim 1, and wherein said plate further includes a weakened segment formed between said first and second end portions of said strut for ease in bending said mounting plate with respect to said support tube, whereby said mounting plate can be fastened in flat abutment with the floor structure of the manufactured building and said support tube oriented at a desired angle extending toward the intersection of the bottom flange and web of the I-beam.

4. The strut of claim 1, and wherein said strut further includes a plurality of openings for receiving connecting elements for connection to the floor structure of the manufactured building.

5. The strut of claim 4, and wherein said connecting elements are screws.

6. The strut of claim 4, and wherein said connecting elements are spikes.

7. The strut of claim 4, and wherein said strut is made of metal.

8. The strut of claim 3, and wherein said weakened segment includes notches extending inwardly from opposed side edges of said strut plate from which said strut is formed.

* * * * *